US009546571B2

(12) United States Patent
Simonds

(10) Patent No.: US 9,546,571 B2
(45) Date of Patent: Jan. 17, 2017

(54) MOUNTING LUG FOR CONNECTING A VANE TO A TURBINE ENGINE CASE

(75) Inventor: Mark E. Simonds, Cape Neddick, ME (US)

(73) Assignee: United Technologies Corporation, Farmington, CT (US)

( * ) Notice: Subject to any disclaimer, the term of this patent is extended or adjusted under 35 U.S.C. 154(b) by 887 days.

(21) Appl. No.: 13/592,085

(22) Filed: Aug. 22, 2012

(65) Prior Publication Data

US 2014/0056702 A1 Feb. 27, 2014

(51) Int. Cl.
*F01D 25/24* (2006.01)
*F01D 25/16* (2006.01)

(52) U.S. Cl.
CPC ..... *F01D 25/243* (2013.01); *F01D 25/162* (2013.01)

(58) Field of Classification Search
CPC ..... F01D 9/042; F01D 25/28; F01D 25/243; F05D 2240/14; F05D 2240/90
See application file for complete search history.

(56) References Cited

U.S. PATENT DOCUMENTS 2,945,290 A * 7/1960 Walsh ..... F01D 9/042 29/889.22
2,982,519 A * 5/1961 Haworth ..... F01D 9/042 415/209.1
4,940,386 A * 7/1990 Feuvrier et al. ..... 415/209.2
5,222,360 A * 6/1993 Antuna et al. ..... 60/226.1
5,224,341 A * 7/1993 Munroe et al. ..... 60/226.1
5,307,623 A * 5/1994 Antuna et al. ..... 60/226.1
6,766,639 B2 7/2004 Malmborg
6,905,303 B2 6/2005 Liu et al.
6,910,860 B2 6/2005 Glover et al.
7,249,929 B2 * 7/2007 Cummings et al. ..... 415/144
7,694,505 B2 4/2010 Schilling
7,730,715 B2 6/2010 Grudnoski et al.
7,815,417 B2 10/2010 Somanath et al.
7,874,802 B2 * 1/2011 Suciu et al. ..... 416/191
7,882,694 B2 2/2011 Suciu et al.
7,963,742 B2 6/2011 Clouse et al.
7,980,817 B2 7/2011 Foose et al.
8,162,605 B2 4/2012 Alvanos et al.
2003/0102670 A1 * 6/2003 Seydel et al. ..... 285/361
2007/0264128 A1 * 11/2007 Grudnoski et al. ..... 416/244 R
2012/0027604 A1 * 2/2012 McDonald et al. ..... 416/219 R
2012/0251306 A1 * 10/2012 Reinhardt et al. ..... 415/182.1

* cited by examiner

*Primary Examiner* — Richard Edgar
(74) *Attorney, Agent, or Firm* — O'Shea Getz P.C.

(57) ABSTRACT

A turbine engine includes a vane and a case with a flange ring. The flange ring defines a channel that extends axially into a side of the flange ring to a channel end surface. The vane has a mounting lug that projects into the channel. The mounting lug includes a lug end surface that extends radially between substantially parallel lug side surfaces, where the lug end surface is engaged with the channel end surface.

20 Claims, 4 Drawing Sheets

MOUNTING LUG FOR CONNECTING A VANE TO A TURBINE ENGINE CASE

BACKGROUND OF THE INVENTION

1. Technical Field

This disclosure relates generally to a turbine engine and, more particularly, to a mounting lug for connecting a vane to a turbine engine case.

2. Background Information

A turbine engine may include a plurality of structural guide vanes arranged between a first case that houses a turbine engine core and a second case that houses a turbine engine fan section. The structural guide vanes are utilized to structurally tie the first case to the second case, which may be connected to an aircraft wing or another engine support structure. The structural guide vanes are also utilized to guide fan bypass air through a bypass duct located radially between the first and the second cases.

Each structural guide vane may include a vane mount that connects a downstream, radial inner end of the vane to a flange ring of the first case. The vane mount typically includes a protrusion with a V-shaped (or curved) sectional geometry that is seated within a channel in the flange ring. The protrusion may extend axially to a protrusion end surface arranged radially between acute angled first and second engagement surfaces, which contact corresponding acute angled engagement surfaces of the channel. One or more fasteners extend axially through the flange ring and into the protrusion, through the protrusion end surface, to connect the vane mount to the flange ring.

Typically, an axial gap extends between the protrusion end surface and an end surface of the channel to ensure full contact between the engagement surfaces of the protrusion and the engagement surfaces of the channel. The gap may allow the protrusion to rotate within the channel under certain vane loading conditions, thereby subjecting the fasteners to undesirable bending stresses. Depending upon the amount of torque applied to the fasteners, the gap may also allow the engagement surfaces of the protrusion to push the engagement surfaces of the channel radially outward, thereby causing the sidewalls of the channel to splay and subjecting the flange ring to undesirable stresses.

SUMMARY OF THE DISCLOSURE

According to a first aspect of the disclosure, a turbine engine is provided that includes a case having a flange ring that defines a channel, and a vane having a mounting lug that projects into the channel. The channel extends axially into a side of the flange ring to a channel end surface. The mounting lug includes a lug end surface that extends radially between substantially parallel lug side surfaces, where the lug end surface is engaged with the channel end surface.

According to another aspect of the invention, a turbine engine is provided that includes a plurality of vanes extending radially between the first case and the second case. The first case has a flange ring that defines a channel, which extends axially into a side of the flanging to a channel end surface. One or more (e.g., each) of the vanes includes a mounting lug projecting into the channel. The mounting lug includes a lug end surface that extends radially between substantially parallel lug side surfaces, where the lug end surface is engaged with the channel end surface.

The flange ring may extend radially to a flange ring end, and the mounting channel may be located adjacent to the flange ring end.

The channel end surface may extend radially between substantially parallel channel side surfaces.

The channel has a channel height that extends radially between the channel side surfaces. The lug has a lug height that extends radially between the lug side surfaces. An average difference between the channel height and the lug height may be less than about twelve one thousandths (0.012) of an inch when, for example, the turbine engine is non-operational. Alternatively, the average difference between the channel height and the lug height may be less than about six one thousandths (0.006) of an inch when, for example, the turbine engine is non-operational.

The channel may have an annular cross-sectional geometry, and the mounting lug may have an arcuate cross-sectional geometry.

The turbine engine may also include a threaded bore and a bolt projected through the flange ring and threaded into the threaded bore. The threaded bore is arranged in the mounting lug and communicates through the lug end surface.

The vane may be one of a plurality of vanes arranged circumferentially around the case. Each of the vanes may include a threaded bore in the respective mounting lug and communicating through the respective lug end surface. A plurality of bolts may project through the flange ring and may be respectively threaded into the threaded bores. The threaded bores in a first and a second of the vanes may have substantially equal diameters. The bolt that threads into the threaded bore in the first of the vanes has a first diameter, and the bolt that threads into the threaded bore in the second of the vanes has a second diameter that may be different than the first diameter.

A threaded insert may be arranged in the threaded bore, and mate with the bolt.

The case may also include a second flange ring. The vane may extend axially between a vane mount and the mounting lug, and the vane mount may be connected to the second flange ring.

The second flange ring may extend radially to a flange ring end. The vane mount may include a mounting plate that engages the flange ring end. At least one bolt may project radially through the mounting plate and into the flange ring end to connect the vane mount to the second flange ring.

The vane may also include a structural stiffening rib that extends axially between the vane mount and the mounting lug.

The vane may also include an airfoil segment that extends radially between a first mounting segment and a second mounting segment, and axially between a leading edge and a trailing edge. The first mounting segment may include the mounting lug and the vane mount.

The second flange ring may be located axially upstream of the flange ring.

The vane may be configured as a structural fan exit guide vane. The first case may be configured as a compressor case, and the second case may be configured as a fan case.

The foregoing features and the operation of the invention will become more apparent in light of the following description and the accompanying drawings.

DETAILED DESCRIPTION OF THE INVENTION

Figure 1:
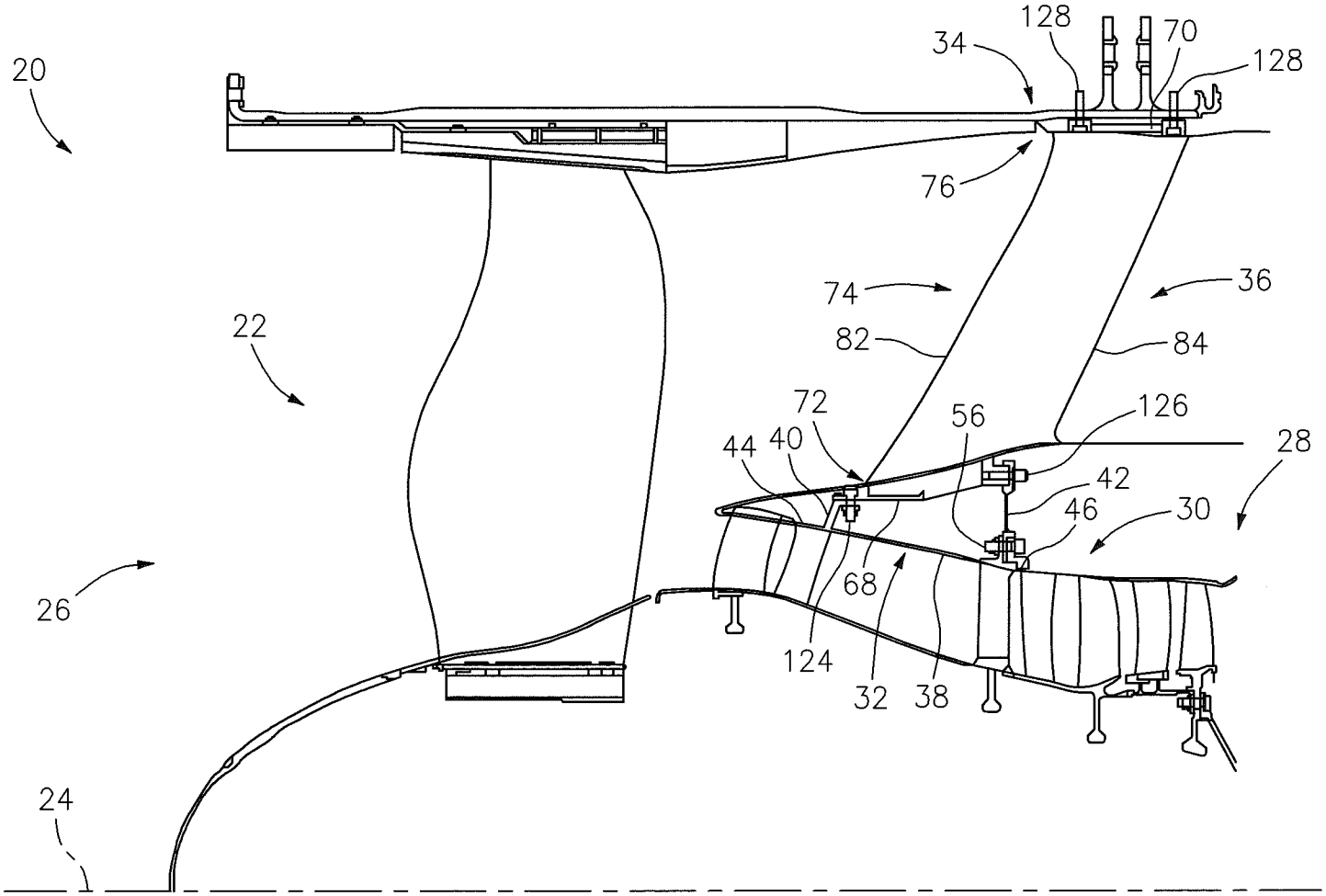
FIG. 1 is a sectional illustration of a forward section of a turbine engine.

FIG. 1 illustrates a forward section of a turbine engine 20. The turbine engine 20 includes a fan section 22 arranged axially, along an axial centerline 24, between a turbine engine inlet 26 and a turbine engine core 28. The turbine engine core 28 includes a compressor section 30, a combustor section (not shown) and a turbine section (not shown). The turbine engine 20 also includes a turbine engine first case 32 (e.g., a compressor case), a turbine engine second case 34 (e.g., a fan case) and a plurality of structural guide vanes 36 (e.g., structural fan exit guide vanes). In the turbine engine embodiment of FIG. 1, at least a portion of the compressor section 30 is arranged radially within the first case 32. At least a portion of the fan section 22 and/or at least a portion of the first case 32 are arranged radially within the second case 34. The structural guide vanes 36 are arranged circumferentially around the axial centerline 24, and connected radially between the first case 32 and the second case 34.

Figure 2:
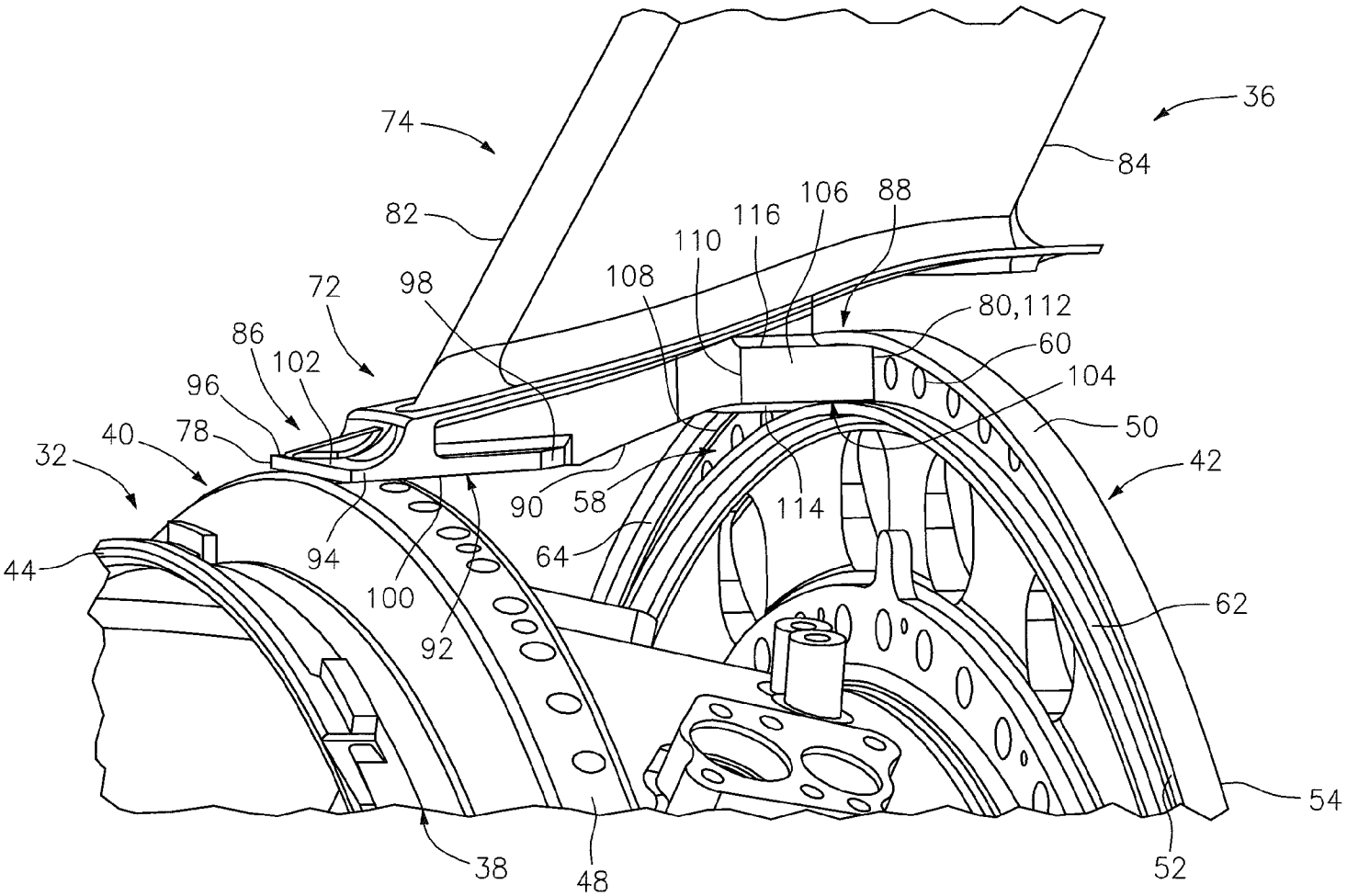
FIG. 2 is a perspective illustration of a connection between a structural guide vane and an engine case.

Referring to FIGS. 1 and 2, the first case 32 includes a first case shell 38, a first flange ring 40 and a second flange ring 42. The first case shell 38 extends circumferentially around the axial centerline 24. The first case shell 38 also extends axially between a first (e.g., upstream) shell end 44 and a second (e.g., downstream) shell end 46.

The first flange ring 40 may be located proximate (or adjacent) the first shell end 44. The first flange ring 40 extends circumferentially around the first case shell 38. The first flange ring 40 also extends radially from the first case shell 38 to a distal first flange ring end 48 (see FIG. 2). The first flange ring 40 may be formed integral with the first case shell 38 as illustrated in FIGS. 1 and 2. Alternatively, the first flange ring may be connected to the first case shell with, for example, a plurality of fasteners (not shown).

The second flange ring 42 may be located adjacent (or proximate) the second shell end 46. The second flange ring 42 extends circumferentially around the first case shell 38. Referring to FIG. 2, the second flange ring 42 extends radially from the first case shell 38 to a distal second flange ring end 50. The second flange ring 42 also carries and extends axially between an upstream annular first side 52 and an opposite downstream annular second side 54. The second flange ring 42 may be connected to the first case shell 38 with, for example, a plurality of fasteners 56 as illustrated in FIG. 1. Alternatively, the second flange ring may be formed integral with the first case shell (not shown).

Figure 3:
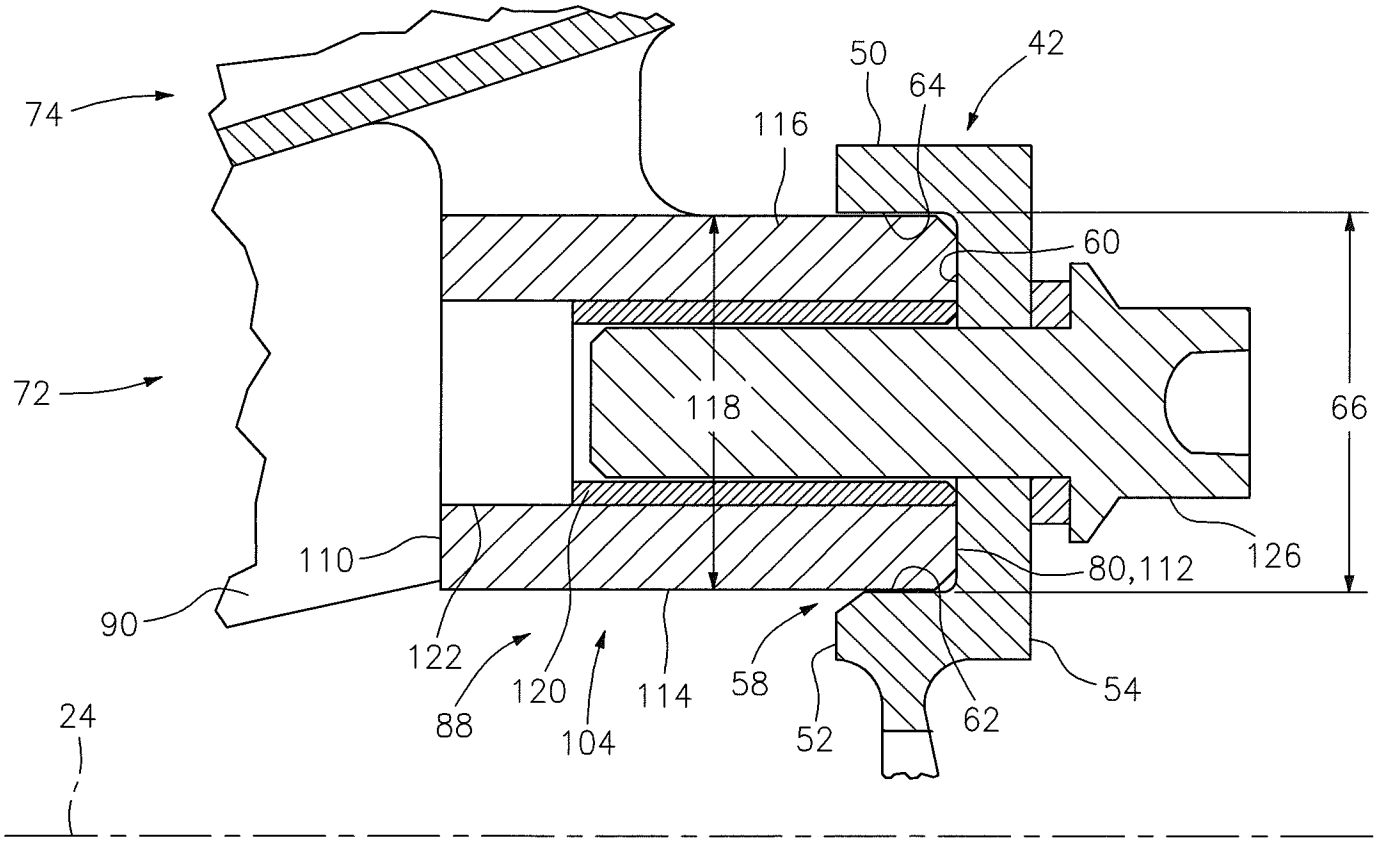
FIG. 3 is a sectional illustration of vane mount that connects the structural guide vane to an engine case flange ring.

Referring to FIGS. 2 and 3, the second flange ring 42 defines at least one mounting channel 58 having, for example, an annular cross-sectional geometry. In the embodiment of FIG. 3, the mounting channel 58 is located adjacent the second flange ring end 50. The mounting channel 58 extends axially into the first side 52 to a channel end surface 60. The mounting channel 58 also extends radially between a first (e.g., radial inner) channel surface 62 and second (e.g., radial outer) channel surface 64, thereby defining a channel height 66 therebetween. The channel end surface 60 extends radially between the first channel surface 62 and the second channel surface 64, and may be substantially perpendicular to the axial centerline 24. The first channel surface 62 and the second channel surface 64 may be substantially parallel to one another as well as, for example, substantially perpendicular to the channel end surface 60.

Referring to FIG. 1, each of the structural guide vanes 36 extends radially between a first (e.g., radial inner) vane end 68 and a second (e.g., radial outer) vane end 70, which is connected to the second case 34 with a plurality of fasteners 128 (e.g., bolts). Each of the structural guide vanes 36 includes a vane first mounting segment 72, a vane airfoil segment 74 and a vane second mounting segment 76.

The first mounting segment 72 extends radially from the first vane end 68 to the vane airfoil segment 74. The first mounting segment 72 also extends axially between a first (e.g., upstream) mounting segment end 78 and a second (e.g., downstream) mounting segment end 80 (see FIG. 2). The vane airfoil segment 74 extends radially between the first mounting segment 72 and the second mounting segment 76. The vane airfoil segment 74 also extends axially between a leading edge 82 and a trailing edge 84. The second mounting segment 76 extends radially between the vane airfoil segment 74 and the second vane end 70.

Referring to FIG. 2, the first mounting segment 72 includes a first (e.g., upstream) vane mount 86 and a second (e.g., downstream) vane mount 88. The first mounting segment 72 may also include at least one structural stiffening rib 90 that extends generally axially between the first vane mount 86 and the second vane mount 88.

The first vane mount 86 includes a mounting plate 92 that spans circumferentially between a first plate side 94 and a second plate side 96. The mounting plate 92 extends axially between, for example, the first mounting segment end 78 and a (e.g., downstream) mounting plate end 98. The mounting plate 92 also extends radially between a first (e.g., radial inner) plate surface 100 and a second (e.g., radial outer) plate surface 102. The present embodiment, however, is not limited to any particular first vane mount configurations. Other non-limiting examples of suitable first vane mount configurations are disclosed in U.S. Pat. No. 7,730,715 and U.S. Pat. No. 6,766,639, each of which is hereby incorporated herein by reference in its entirety.

Referring to FIGS. 1 and 2, each first plate surface 100 engages (e.g., contacts) the first flange ring end 48. One or more first fasteners 124 (e.g., bolts) extend radially through each respective mounting plate 92 and into the first flange ring end 48, thereby connecting the respective first vane mount 86 to the first flange ring 40.

Referring to FIGS. 2 and 3, the second vane mount 88 includes a mounting lug 104 that extends circumferentially between a first lug side 106 and a second lug side 108. The mounting lug 104 extends axially between a (e.g., upstream) lug end 110 and a distal (e.g., downstream) lug end surface 112, which is located at the second mounting segment end 80. Referring to FIG. 3, the mounting lug 104 also extend radially between a first (e.g., radial inner) lug surface 114 and a second (e.g., radial outer) lug surface 116, thereby defining a lug height 118 therebetween. The lug end surface 112 extends radially between the first lug surface 114 and the second lug surface 116, and may be substantially perpendicular to the axial centerline 24. The first lug surface 114 and the second lug surface 116 may be substantially parallel to one another as well as, for example, substantially perpendicular to the lug end surface 112. The lug height 118 is less than or equal to the channel height 66. In one embodiment, for example, a difference between the lug height 118 and the channel height 66 may be less than twelve one thousandths (0.012) of an inch when, for example, the turbine engine is non-operational. In another embodiment, the difference between the lug height 118 and the channel height 66 may be less than six one thousandths (0.006) of an inch when, for example, the turbine engine is non-operational. In this manner, the mounting lug 104 may be mated with the mounting channel 58 without splaying the first and second channel surfaces 62 and 64 apart, which may reduce stresses within the second flange ring 42. The lug end surface 112, for example, engages (e.g., contacts) the channel end surface 60 without, for example, an axial load being transferred between the mounting lug 104 and the first and/or second channel surfaces 62 and 64. The present embodiment, of course, is not limited to any particular dimensional relationship between the mounting lug 104 and the mounting channel 58.

One or more second fasteners (e.g., bolts) 126 project axially through the second flange ring 42 and are mated with respective fastener apertures 122, thereby connecting the respective second vane mount 88 to the second flange ring 42. Each of the fastener apertures 122 communicates with the lug end surface 112 and, thus, extends axially into the mounting lug 104 from the lug end surface 112 towards (e.g., to) the lug end 110. The fastener apertures 122 may have substantially equal diameters. Threaded inserts 120 may be arranged (e.g., embedded) within the fastener apertures 122 to mate with the second fasteners 126 where, for example, the mounting lug 104 is constructed from a relatively soft material such as aluminum. The threaded inserts 120 may have substantially equal inner diameters. An example of a threaded insert is a Heli-Coil® insert, which is manufactured by Emhart Technologies, Shelton, Conn., United States. The present embodiment, for course, is not limited to any particular threaded insert configuration.

In some embodiments, each of the second fasteners 126 (e.g., bolts) may have substantially equal shank diameters. The term "shank" is used herein to describe a threaded section of a fastener that engages, for example, a fastener aperture or a threaded insert within the aperture. In other embodiments, the second fasteners 126 may include one or more base tolerance second fasteners 126, and one or more close tolerance second fasteners 126. The base tolerance second fasteners 126 each have a shank with a first fastener diameter. The close tolerance second fasteners 126 each have a shank with a second fastener diameter that is greater than the first fastener diameter. By utilizing the different sized second fasteners 126 with the equal sized fastener apertures 122 and/or equal sized threaded inserts 120, the second fasteners 126 may reduce or prevent circumferential and/or radial shifting between the structural guide vanes 36 and the second flange ring 42. The close tolerance second fasteners 126, for example, may be utilized to account for manufacturing tolerances and/or imperfections of aperture locations in the second flange ring 42 and/or in the lugs 104. In this embodiment, the close tolerance second fasteners 126 account for less than, for example, about fifty percent (50%) of the second fasteners 126.

Figure 4:
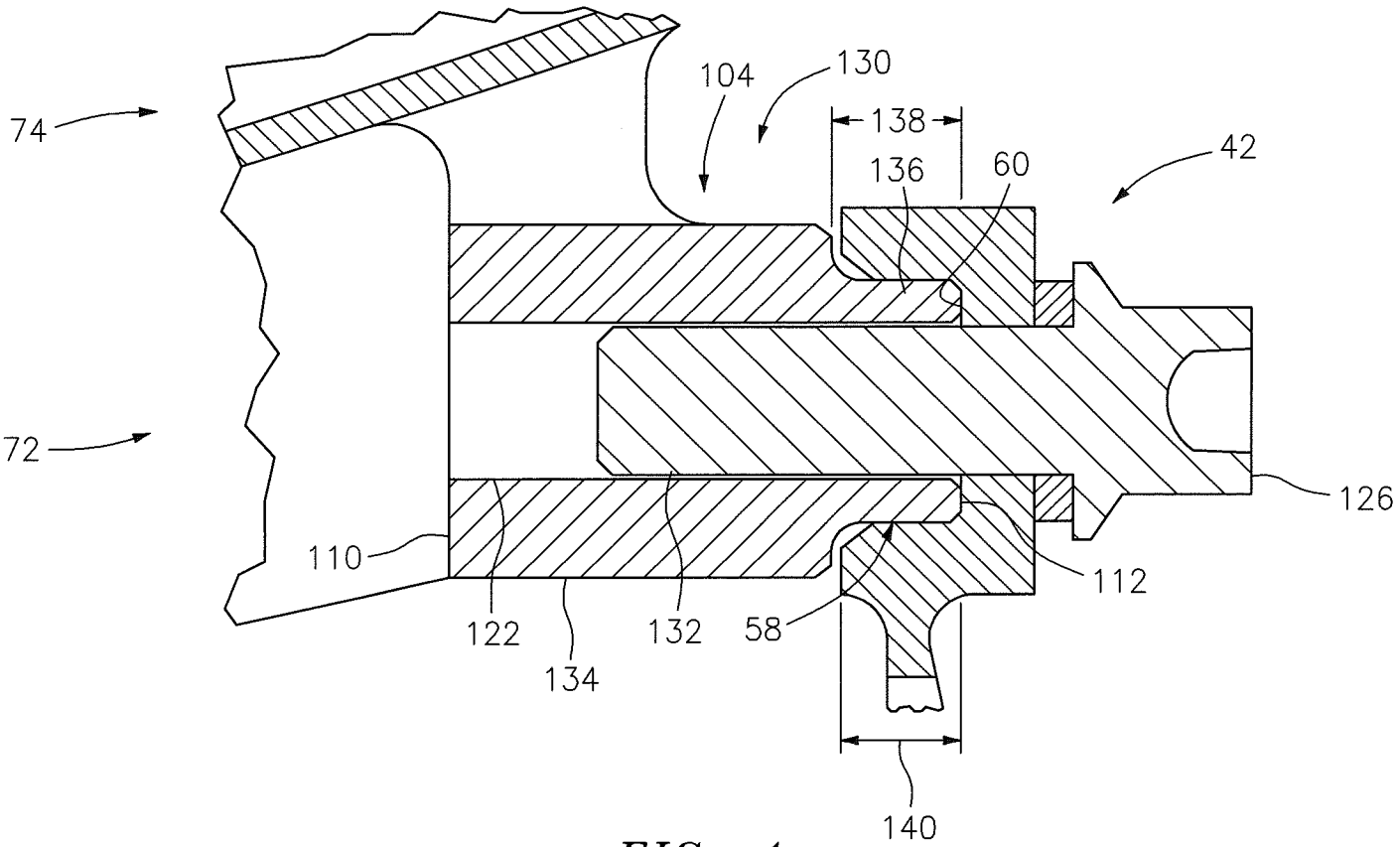
FIG. 4 is a sectional illustration of an alternative embodiment vane mount that connects the structural guide vane to the engine case flange ring.

FIG. 4 illustrates an alternative embodiment second vane mount 130. In contrast to the second vane mount 88 illustrated in FIG. 3, the second vane mount 130 does not include the threaded inserts 120. Rather, the shanks 132 of the second fasteners 126 are mated directly with (e.g., threaded into) the fastener apertures 122 (e.g., threaded bores). In addition, the mounting lug 104 may have a stepped geometry with a base section 134 and a channel engagement section 136. The base section 134 extends axially from the lug end 110 to the channel engagement section 136. The channel engagement section 136 extends axially from the base section 134 to the lug end surface 112, thereby defining an engagement section length 138 therebetween. In the embodiment of FIG. 4, the engagement section length 138 is greater than or equal to an axial length 140 of the mounting channel 58, which ensures the lug end surface 112 engages the channel end surface 60 without substantially deforming the second flange ring 42; e.g., without splaying sidewalls of the mounting channel 58.

A person of skill in the art will recognize that the aforedescribed mounting lug 104 and mounting channel 58 arrangement may alternatively be utilized to connect other portions of the structural guide vane 36 other than the second mounting segment end 80 to the first and/or the second cases 32 and 34. In some embodiments, for example, the mounting lug 104 and mounting channel 58 arrangement may be utilized to connect the first mounting segment end 78 to the first flange ring 40. In other embodiments, the mounting lug 104 and mounting channel 58 arrangement may be utilized to connect the second mounting segment 76 to the second case 34. The present invention therefore is not limited to any particular mounting lug 104 and mounting channel 58 arrangement locations.

While various embodiments of the present invention have been disclosed, it will be apparent to those of ordinary skill in the art that many more embodiments and implementations are possible within the scope of the invention. For example, the present invention as described herein includes several aspects and embodiments that include particular features. Although these features may be described individually, it is within the scope of the present invention that some or all of these features may be combined within any one of the aspects and remain within the scope of the invention. Accordingly, the present invention is not to be restricted except in light of the attached claims and their equivalents.

What is claimed is:

1. A turbine engine, comprising:

a case having a flange ring defining a channel that extends axially into a side of the flange ring to a channel end surface; and a vane having a mounting lug projecting into the channel, the mounting lug including a lug end surface that extends radially between substantially parallel lug side surfaces, wherein the lug end surface is engaged with the channel end surface, and wherein the substantially parallel lug side surfaces extend axially into the channel.

2. The turbine engine of claim 1, wherein the flange ring extends radially to a flange ring end, and the mounting channel is located adjacent to the flange ring end.

3. The turbine engine of claim 1, wherein the channel end surface extends radially between substantially parallel channel side surfaces.

4. The turbine engine of claim 3, wherein the channel has a channel height that extends radially between the channel side surfaces, the lug has a lug height that extends radially between the lug side surfaces, and an average difference between the channel height and the lug height is less than about twelve one thousandths (0.012) of an inch when the turbine engine is non-operational.

5. The turbine engine of claim 4, wherein the average difference between the channel height and the lug height is less than about six one thousandths (0.006) of an inch when the turbine engine is non-operational.

6. The turbine engine of claim 1, wherein the channel has an annular cross-sectional geometry, and the mounting lug has an arcuate cross-sectional geometry.

7. The turbine engine of claim 1, further comprising:

a threaded bore in the mounting lug and communicating through the lug end surface; and a bolt projected through the flange ring and threaded into the threaded bore.

8. The turbine engine of claim 7, wherein a threaded insert is arranged in the threaded bore, and mates with the bolt.

9. The turbine engine of claim 1, wherein the case further includes a second flange ring, the vane extends axially between a vane mount and the mounting lug, and the vane mount is connected to the second flange ring.

10. The turbine engine of claim 9, wherein the second flange ring extends radially to a flange ring end, the vane mount includes a mounting plate that engages the flange ring end, and at least one bolt projects radially through the mounting plate and into the flange ring end to connect the vane mount to the second flange ring.

11. The turbine engine of claim 9, wherein the vane further includes a structural stiffening rib that extends axially between the vane mount and the mounting lug.

12. The turbine engine of claim 9, wherein the vane further includes an airfoil segment that extends radially between a first mounting segment and a second mounting segment, and axially between a leading edge and a trailing edge, and wherein the first mounting segment includes the mounting lug and the vane mount.

13. The turbine engine of claim 12, wherein the second flange ring is located axially upstream of the flange ring.

14. The turbine engine of claim 1, wherein the vane comprises a structural fan exit guide vane.

15. The assembly of claim 14, wherein the case comprises a compressor case.

16. A turbine engine, comprising:

a case having a flange ring defining a channel that extends axially into a side of the flange ring to a channel end surface; and a vane having a mounting lug projecting into the channel, the mounting lug including a lug end surface that extends radially between substantially parallel lug side surfaces, wherein the lug end surface is engaged with the channel end surface;

wherein the vane is one of a plurality of vanes arranged circumferentially around the case, and each of the vanes includes a threaded bore in the respective mounting lug and communicating through the respective lug end surface;

wherein a plurality of bolts project through the flange ring and are respectively threaded into the threaded bores;

wherein the threaded bores in a first and a second of the vanes have substantially equal diameters; and wherein the bolt that threads into the threaded bore in the first of the vanes has a first diameter, and the bolt that threads into the threaded bore in the second of the vanes has a second diameter that is different than the first diameter.

17. A turbine engine, comprising:

a first case having a flange ring defining a channel that extends axially into a side of the flange ring to a channel end surface;

a second case;

a plurality of vanes extending radially between the first case and the second case, wherein one or more of the vanes each includes a mounting lug projecting into the channel, the mounting lug of a first of the vanes includes a lug end surface that extends radially between substantially parallel lug side surfaces, and the lug end surface is engaged with the channel end surface;

a threaded bore in the mounting lug of the first of the vanes and communicating through the lug end surface; and a bolt projected through the flange ring and threaded axially into the threaded bore;

wherein the substantially parallel lug side surfaces extend axially into the channel.

18. The turbine engine of claim 17, wherein the parallel lug side surfaces extend axially towards the lug end surface.

19. The turbine engine of claim 17, wherein a first chamfer surface extends between a first of the parallel lug side surfaces and the lug end surface, and a second chamfer surface extends between a second of the parallel lug side surfaces and the lug end surface.

20. The turbine engine of claim 17, wherein the vanes are configured as fan exit guide vanes.

* * * * *